United States Patent [19]

Tsuchitani et al.

[11] Patent Number: 4,874,502

[45] Date of Patent: Oct. 17, 1989

[54] METHOD OF PURIFYING COAL TARS FOR USE IN THE PRODUCTION OF CARBON PRODUCTS

[75] Inventors: Masatoshi Tsuchitani, Ichihara; Sakae Naito, Chiba, both of Japan

[73] Assignee: Maruzen Petrochemical Co., Ltd., Tokyo, Japan

[21] Appl. No.: 220,908

[22] Filed: Jul. 19, 1988

Related U.S. Application Data

[63] Continuation of Ser. No. 936,978, Nov. 28, 1986, abandoned, which is a continuation-in-part of Ser. No. 850,143, Apr. 10, 1986, abandoned.

[30] Foreign Application Priority Data

Apr. 16, 1985 [JP] Japan ..... 60-80793

[51] Int. Cl.[4] ..... C10C 1/08; C10C 1/04; D01F 9/12; D01F 9/14

[52] U.S. Cl. ..... 208/45; 208/22; 208/42; 264/29.2; 423/447.1; 423/447.4

[58] Field of Search ..... 208/22, 39, 40, 42, 208/44, 45; 264/29.2; 423/497.1, 447.4

[56] References Cited

U.S. PATENT DOCUMENTS

| | | | |
|---|---|---|---|
| 4,277,235 | 7/1981 | Greenwood | 208/45 |
| 4,402,928 | 9/1983 | Lewis et al. | 208/40 |
| 4,575,412 | 3/1986 | Yudate et al. | 208/44 |
| 4,578,177 | 3/1986 | Yudate et al. | 208/44 |
| 4,758,326 | 7/1988 | Obsugi et al. . | |
| 4,820,401 | 4/1989 | Tsuchitani et al. | 208/40 |

*Primary Examiner*—Paul E. Konopka

*Attorney, Agent, or Firm*—Frishauf, Holtz, Goodman & Woodward

[57] ABSTRACT

The unwanted components from coal tars should be removed at a certain stage of the process for producing homogeneous spinning pitches which are suitable for use in the production of high-performance carbon fibers from coal tars. The unwanted components can be eliminated from coal tars in a very efficient manner by the following procedures: subjecting the coal tars to distillation or flash distillation so as to separate a heavy component having a boiling point higher than a predetermined temperature, dissolving the heavy component in a monocyclic aromatic hydrocarbon solvent, and subjecting the solution to filtration or centrifugation.

4 Claims, No Drawings

METHOD OF PURIFYING COAL TARS FOR USE IN THE PRODUCTION OF CARBON PRODUCTS

This application is a continuation of application Ser. No. 936,978 filed Nov. 28, 1986 which is a continuation-in-part application of Ser. No. 850,143 filed Apr. 10, 1986, both now abandoned.

BACKGROUND OF THE INVENTION

1. Field of the Invention

The present invention relates to a process which is capable of efficient production of purified heavy components from coal tars which are suitable for use as starting materials in the production of carbon products. More particularly, the present invention relates to a method of purifying the starting materials for use in the production of carbon products comprising the following steps: distilling or flashing coal tar to obtain a heavy component composed of fractions having boiling points higher than a predetermined temperature; mixing said heavy component with a monocyclic aromatic hydrocarbon solvent to form a solution; subjecting the resulting solution to filtration or centrifugation so as to separate and remove the insoluble component; and distilling off the solvent. The purified heavy component obtained by the method of the present invention is particularly suitable for use in the production of high-performance carbon fibers.

2. Prior Art

High-performance carbon fibers are lightweight and have high strength and elastic modulus properties. Because of these features, high-performance carbon fibers are gaining increasing attention as components of composite materials for use in air-craft, sporting goods, industrial robots, etc. and a rapid increase in the demand for such carbon fibers is expected to occur in the future.

Most of the high-performance carbon fibers available today are produced from polyacrylonitrile (PAN) which is spun into filaments, rendered infusible in an oxidizing atmosphere, and is subsequently carbonized or graphitized in an inert atmosphere. Recently, it has been found that high-performance carbon fibers having characteristics which are equal to or better than the PAN-based carbon fibers can also be produced from inexpensive pitches, and several processes have been proposed for producing pitch-based carbon fibers.

According to known methods for producing pitch-based carbon fibers, preliminarily hydrogenated pitches are heat-treated to become suitable for use in subsequent spinning (see, for example, Japanese Patent Laid-Open Publication No. 196292/1983) or pitches are rendered suitable for use in spinning by heating them for a prolonged period at a relatively low temperature (see, for example, Japanese Patent Laid-Open Publication No. 86717/1978). The spinning pitches which are suitable for use as the starting materials for producing high-performance carbon fibers must be "mesophase" pitches the primary component of which is the mesophase which exhibits an optical anisotropy when observed under a polarized light.

The mesophase is a kind of liquid crystal that forms when heavy oils or pitches are heated. The optical anisotropy of the mesophase is believed to result from the laminar structure of the planar aromatic molecules developed by thermal polymerization When mesophase pitches are subjected to melt spinning, the planar aromatic molecules are aligned parallel to the filament axis under the stress which is exerted during passage through a spinning nozzle hole. This oriented structure is stable and maintained through subsequent stages of fiber production (i.e., rendering the filaments infusible and carbonizing the infusible filaments) such as to provide high-performance carbon fibers having good orientation.

The mesophase pitches can be produced from coal tars, tars as by-products of thermal cracking of naphtha, tars as by-products of thermal cracking of gas oils, and decant oils, but coal tars are used most commonly because of such advantages as low aliphatic contents, high aromaticity and high pitch yield.

Coal tars which are the heavy oils obtained as by-products of the dry distillation of coal contain very fine (0.1–0.3 $\mu$m) sooty substances which are commonly referred to as free carbons. Coal tars also contain components having very high molecular weights.

When coal tars are heat-treated to produce mesophases, the free carbons are deposited on the mesophases such as to upset the laminar structure of the planar aromatic molecules in the mesophases. It is therefore impossible to make mesophase pitches having good orientation from coal tars containing the free carbons. In addition, the free carbons are solid substances which will not melt at elevated temperatures and can cause filament breakage during spinning or may produce low-strength fibers. It is therefore essential that the free carbons are eliminated at a certain stage of the process of making spinning pitches. The free carbons are insoluble in quinoline and can be removed from coal tars or pitches by subjecting quinoline solutions thereof to filtration or centrifugation, and this is a practice commonly employed on a laboratory scale. However, as already mentioned, the free carbons are in the form of very fine particles and can be filtered out only at very slow rates or can be separated by centrifugation with very low efficiency. It is therefore almost impossible to accomplish complete removal of the free carbons by carrying out filtration or centrifugation on an industrial scale.

The components of very high molecular weights in the coal tars become much higher in molecular weight as a result of thermal polymerization that occurs in the initial stage of heat treatment because of the high rate of reaction involved in the formation of mesophases or in carbonization. Such components of extremely high molecular weights will not only impair the homogeneity of the spinning pitches but also increase their melting points. Mesophase pitches start to soften at relatively high temperatures (250°–300° C.), so they have to be spun at significantly high temperatures (≧300°–350° C.). It is said that most organics start to decompose in this temperature range. Therefore, the first requirement that should be met in order to produce carbon fibers of good quality is to prepare homogeneous spinning pitches which have minimal contents of those components of very high molecular weights which increase the melting points of the pitches.

Several methods for removing the free carbons and components of very high molecular weights (the two will hereunder be collectively referred to as "unwanted component") from coal tars by filtration or centrifugation have been proposed: in one method, aromatic and aliphatic solvents are used at specific mixing proportions (as in Japanese Patent Laid-Open Publication No. 78201/1977); in another method, hydrocarbons having BMCI values within a certain range are used as solvents (as in Japanese Patent Laid-Open Publication No. 28501/1977); and in still another method, solvents having a characterization factor within a specific range are used (as in U.S. Pat. No. 4,292,170). The essence of these methods is the same in that the ability of the solvent to dissolve coal tars is adjusted to the proper range. Since the solvent employed in these methods is either a mixture of two or more solvents or a light oil which is a complex mixture, the mixing proportions of the solvent components or the solubilizing ability of the solvent must be closely controlled when the solvent is recovered or put to another use.

The unwanted components may be eliminated from pitches without using solvents; for example, the pitches are directly subjected to filtration under heating (as in Japanese Patent Laid-Open Publication No. 142820/1975); or the pitches are subjected to filtration under heating after they are heat-treated to form small amounts of mesophases (as in Japanese Patent Laid-Open Publication No. 136836/1983). These methods are effective for the purpose of eliminating the unwanted components to produce homogeneous spinning pitches. However, if one wants to separate the free carbons from the pitches by direct filtration, the rate of filtration is very slow and its efficiency is extremely low since the free carbons are in the form of very fine particles (0.1–0.3 μm). Even if the pitches are subjected to filtration under heating after they are heat-treated to form small amounts of mesophases, the resulting mesophases also exist as small spheres with a diameter in the order of a few microns. In addition, the mesophases are composed of molecules which are similar to those making up the non-mesophased isotropic components, and the latter works as a swelling agent for the mesophases such that, under heating, the mesophases either dissolve or swell and are thus softened to such an extent that the efficiency of filtration is markedly reduced.

U.S. Pat. Nos. 4,578,177 and 4,575,412 disclose a process for removing unwanted components from pitches consisting a step of heating the pitches to 350°–500° C. to give 10–30% by weight of mesophases due to condensation polymerization of components having very high molecular weights, dissolving so heat-treated pitches in an aromatic hydrocarbon solvent, and then removing insoluble components from the resulting solution. In this process, unwanted components are removed by bonding free carbons to the surface of mesophase particles produced by condensation polymerization of components having very high molecular weights. However, this process leads to a reduced efficiency of filtration in terms of the removal of insoluble components by filtration from the solution in which heat-treated pitches are dissolved in an aromatic hydrocarbon solvent.

Under the circumstances described above, it is desired to develop a method which is capable of efficient removal of the unwanted components from coal tars on an industrial scale at a certain stage of the process for producing spinning pitches suitable for use as starting materials in the production of carbon fibers.

SUMMARY OF THE INVENTION

It is therefore and object of the present invention is to provide a simple and industrially feasible method for removing the absolutely unwanted components from coal tars at a certain stage of the process for producing spinning pitches which are suitable for use in the production of high-performance carbon fibers.

Another object of the present invention is to provide a simple industrial method for providing a heavy component which is purified to a degree that makes it suitable for use as the starting material for producing high-performance carbon fibers.

Needless to say, the purified heavy component obtained by the method of the present invention may be used as the starting material for the production of not only carbon fibers but also of other carbon products such as high-grade coke and pitch impregnates.

Other object and advantages of the present invention may become apparent to those skilled in the art from the following description and disclosure.

DETAILED DESCRIPTION OF THE PREFERRED EMBODIMENT

The present invention relates to a method of purifying a starting material for the production of carbon products, said method comprising the following steps:

subjecting to dsstillation or flash distillation, involving substantially no reactions such as thermal condensation polymerization or thermal decomposition reaction, at a temperature within the range of 250°–350° C. (when run at atmospheric pressure) and at atmospheric or subatmospheric pressure, coal tars containing a component which has an initial boiling point of not more than 280° C. at atmospheric pressure and containing a fraction in an amount of at least 10% by weight which has a boiling point between the initial boiling point and 350° C. at atmospheric pressure, and xylene-insoluble components in an amount of 15% or less by weight; thereby to remove light components therefrom;

obtaining a heavy component which remains in the bottom of the distillation or flash column; said heavy components having a greater xylene-insoluble content of at least 1% and not more than 10% weight than that of said coal tar; and having a xylene-insoluble content of not more than 20% by weight of said heavy components;

mixing the recovered heavy component with 1–3 times its amount of a monocyclic aromatic hydrocarbon solvent to form a solution at a temperature ranging from ordinary temperature to the boiling point of said solvent used and a temperature adequate to impart sufficient flowability to said heavy component under atmospheric pressure or application of pressure;

separating and eliminating the insoluble component from the resulting solution by filtration or centrifugation, said insoluble component mainly comprising free carbons and components having very high molecular weights; and subsequently eliminating the solvent by distillation so as to obtain a purified heavy component, said purified heavy component substantially being free from the above insoluble component mainly comprising free carbons and components having very high molecular weights.

Suitable coal tars which may be used as a starting material in the present invention contain a component which has an initial boiling point of 280° C. or lower at atmospheric pressure, preferably 250° C. or lower and contains a fraction in an amount of 10% or more by weight, preferably 20% or more by weight which has a boiling point between said initial boiling point and 350° C. at atmospheric pressure, and xylene-insoluble components in an amount of 15% or less by weight, preferably 10% or less by weight.

When coal tars containing a fraction which has a higher initial boiling point than the above and a boiling point of 350° C. or lower at atmospheric pressure are used as the starting material or when such fraction is contained in an amount of less than 10% by weight, the markedly improved effectiveness of removing unwanted components (i.e., fractions) cannot be achieved even if a light component is removed according to the method of the present invention. When coal tars containing a great amount of xylene-insoluble components are used as a starting material, a higher amount of component is removed as an unwanted component, resulting in a reduced yield of the object purified heavy component.

The monocyclic aromatic hydrocarbon solvent may be illustrated by benzene, toluene, xylene, etc. which may be used either independently or in combination. Therefore, the method of the present invention is first of all characterized by the use of such easily available solvents. Secondly, the method allows these solvents to be readily recovered and put to another use because instead of trying to improve the efficiency of the removal of the unwanted components by strictly controlling the solubilizing ability of the solvent, the method of the present invention relies upon the simple procedure of adding the solvent after the solubility of coal tars has been changed by such a simple operation as the distillation or flash distillation of the coal tars.

In accordance with the present invention, distillation or flash distillation of coal tars may be carried out at either atmospheric or subatmospheric pressure so long as a light component having a lower boiling point than the range of 250°-350° C. at atmospheric pressure can be substantially removed by such distillation or flash distillation. Therefore, the distillation or flash distillation of coal tars can be readily accomplished without using any special skill.

A heavy component obtained from the bottom of the column by the distillation or flash distillation usually gives a 1-10% by weight higher xylene-insoluble content than the coal tar used as a starting material. More than 20% by weight of xylene-insoluble content in a heavy component undesirably leads to a reduced yield of the object purified heavy component. Therefore, it is desirable to select suitable distillation condition that will give less than 20% by weight of xylene-insoluble content in the heavy component.

In this distillation or flash distillation, substantially no reactions such as thermal condensation polymerization, thermal decomposition or the like take place.

The resulting heavy component and 1-3 times its amount of a monocyclic aromatic hydrocarbon solvent are desirably mixed with stirring for a certain time sufficient to dissolve soluble components under pressure of from atmospheric pressure to about 2 kg/mc$^2$G at a temperature ranging from ordinary temperature to the boiling point of said solvent used and a temperature adequate to impart a sufficient flowability to said heavy component.

According to the method of the present invention, since a liquid heavy component having sufficient flowability is mixed with a solvent in the above solvent treatment of the heavy component, mixing and dissolving operation are easy, and it only takes a short time to accomplish complete dissolution of the soluble components. In the practice of the method of the present invention, a heavy component may be heated to a temperature adequate to impart sufficient flowability to it prior to mixing with a solvent of ordinary temperature.

Surprisingly enough, when the so obtained heavy component is mixed with 1-3 times its amount of a monocyclic aromatic hydrocarbon solvent, the insoluble component mainly comprising free carbons and components having very high molecular weights can be eliminated from the solution very easily by means of filtration or centrifugation.

This may be apparent from the results of the following experiment: coal tars were subjected to atmospheric flash distillation at 250° C., 290° C. or 340° C. and the recovered heavy component was mixed with twice its amount of xylene; the resulting solution was subjected to filtration at 1.5 kg/cm$^2$G at ambient temperature on a pressure filter (effective area: 0.025 m$^2$) equipped with a glass fiber impregnated filter paper; the average rate of filtration as calculated for the period from the passage of the first one kilogram of the feed solution to the passage of the next four kilograms of the feed was 154, 213 or 374 kg/m$^2$ hr for the distillation temperature of 250° C., 290° C. or 340° C., respectively. These values are quite high compared with 33 kg/m$^2$ hr which is the average rate of filtration under pressure of a mixture of non-flashed coal tar with twice its amount of xylene. This is an entirely unexpected result in that although the heavy component obtained by the second step of the method of the present invention is the residue that has resulted from the distillation or flash distillation of coal tars at a temperature between 250° C. and 350° C. in terms of atmospheric pressure and which hence has become heavier by the amount corresponding to the loss of the light components, this thick heavy component is much more easily filterable than the untreated coal tars (containing light components) when they are diluted with the same amount of xylene.

The coal tars employed in the experiment contained 4.7 wt % of xylene insolubles. The heavy components obtained by subjecting such coal tars to flash distillation at 250° C., 290° C. and 340° C. contained 5.8, 7.1 and 10.6 wt %, respectively, of xylene insolubles. When calculated on the basis of the initial coal tars, these values amount to 4.9, 5.4 and 6.7 wt %, indicating that the content of xylene insolubles was increased slightly by merely eliminating the light components from coal tars by flash distillation. Although the increase in the content of xylene insolubles that results from the elimination of the light components is very small, the heavy component which remains after elimination of such light components can be filtered off very rapidly when it is dissolved in a monocyclic aromatic hydrocarbon solvent Although the exact reason for this phenomenon is not clear, a plausible explanation is as follows: in a heavy oil such as coal tar, the component of high molecular weight would exist not as independent molecules but as a micelle which is an aggregation of such molecules; if the light component which works as a good solvent or dispersant for this micelle is eliminated from the coal tar, miscelle formation proceeds and the amount of the solvent-insoluble matter increases slightly such that the insoluble content which is dispersed in the mixture with the solvent is grown to a particle size that is large enough to be easily filtered off at high rate. Another interesting fact is that the component that can be dissolved in solution using a large amount of solvent as in the case of measurement of the insoluble content seems to differ from the component that can be dissolved using a small amount of solvent as in the case of the present invention, and the xylene-insoluble content of the purified heavy component that has been obtained by the method of the present invention using xylene as the solvent is not necessarily zero. A plausible explanation of this phenomenon is that at a small solvent ratio, the heavy component itself which is to be dissolved exhibits a by no means insignificant action as a solvent for the high-molecular weight component. However, even in this case, that part of the high-molecular weight component measured as the xylene-insoluble matter which has a particularly high molecular weight seems to precipitate faster than the remaining portion, and the purified heavy component contains nothing that has such a high-molecular weight as to be measured as the quinoline-insoluble content.

If the rate of filtration employed for the purpose of removing the insoluble matter is extremely slow, a filtering apparatus having a very large effective area is necessary but this is too uneconomical to be used in an industrial operation.

As will be apparent from the experimental data shown above, the rate of filtration of the heavy component increases with its boiling point. However, if the heavy component has an excessively high boiling point, the content of the insoluble matter is increased to reduce the recovery of the purified heavy component. At the same time, the amount of the filter cake is increased to such an extent that the frequency of cake removal is increased to reduce, rather than improve, the efficiency of filtration.

As for the amount of the solvent used, it should be increased in order to attain a high rate of filtration but, on the other hand, this is not economical since using a large amount of the solvent leads to an increase in the total amount of the mixture that must be worked up. If the solvent is used in an excessively small amount, the viscosity of the solution is increased to reduce the rate of filtration. At the same time, as already mentioned, the action of the heavy component as the solvent becomes significant and the growth of the insoluble matter is not sufficient to ensure high filtration rate.

If most efficient conditions of filtration are selected by considering these factors, a filtrate which is free from the insoluble content can be readily obtained, and by removing the solvent from this filtrate by distillation, a desired purified heavy component substantially free from the insoluble component mainly comprising free carbons and components having very high molecular weights is recovered.

By following the procedures described above, the unwanted components can be efficiently removed from coal tars, leaving a purified heavy component which is suitable for use as the starting material for the production of high-performance carbon fibers.

Spinning pitches which can be processed into high-performance carbon fibers may be prepared from the purified heavy component that has been obtained by the method of the present invention. While known methods such as the ones described in Japanese Patent Laid-Open Publication Nos. 86717/1978 and 196292/1983 may be employed in order to make spinning pitches from the purified heavy component, it is necessary to convert the isotropic pitch to the mesophase pitch in each of these methods In the case of the purified heavy component that has been obtained by the method of the present invention, it is preferable to produce a high-softening point pitch by further reducing the content of the light component prior to its conversion to the mesophase pitch. If the purified heavy component obtained by the method of the present invention is directly subjected to a treatment for conversion to the mesophase pitch, the yield of the mesophase pitch obtained is low and the overall process efficiency is reduced because of the need for working up an increased amount of the heavy component in the treatment for conversion to the mesophase pitch. The residual light component may be removed and a high-softening point pitch obtained by vacuum distillation, heat treatment or flash distillation at high temperature. One preferable method may proceed as follows: the purified heavy component obtained by the present invention is heat-treated in a tubular over at 4–50 kg/cm$^2$G and 400°–520° C. for a residence time of 30–1,000 seconds; the heated product is fed to a flash column where it is subjected to flash distillation at 0–3 kg/cm$^2$ (abs) and 380°–520° C. (this method is hereunder referred to as the high-temperature flash process). This method allows the residual light component to be removed efficiently, thereby yielding a homogeneous pitch. Using the purified heavy component obtained by the method of the present invention, a highly homogeneous pitch can be obtained since said heavy component has been freed of the unwanted components initially present in coal tars.

One preferable method for converting the high-softening point pitch to a mesophase pitch may proceed as follows: the high-softening point pitch is mixed with 1–3 times its amount of a hydrogenation solvent such as tetrahydroquinoline; the mixture is heat-treated at 400°–450° C. at an autogeneous pressure; the solvent is removed from the treated solution so as to obtain a hydrogenated pitch; the pitch then is heat-treated at above 400° C. under bubbling of an inert gas.

This method may be applied to the pitch obtained by direct treatment of coal tar in accordance with the "high-temperature flash process", and a mesophase pitch having good spinnability can be produced. But to this end, at least the free carbons present in the coal tar must be removed by all means. Therefore, it becomes necessary to remove the insoluble content either after the pitch is dissolved in a hydrogenerating solvent or after the solution is heat-treated at autogeneous pressure. However, as already mentioned, the free carbons are in a very fine particulate form and the efficiency of their filtration is very low. If coal tar is immediately treated by the high-temperature flash process, a pitch having a softening point of 164° C. (ring and ball test) and a quinoline-insoluble content of 2.3% may result; when this pitch as mixed with twice its amount of hydrogenated quinoline containing 60% tetrahydroquinoline is subjected to filtration at 1.5 kg/cm$^2$.G on a pressure filter with an effective area of 0.025 m$^2$, the average rate of filtration attainable is only 13 kg/m$^2$.hr, which is too low to provide industrially satisfactory results. On the other hand, if the purified heavy component obtained by the method of the present invention is treated by the high-temperature flash process, a pitch having a very low insoluble content will result and even if it has a softening point of 177° C., the content which is insoluble in hydrogenated quinoline containing 60% tetrahydroquinoline is substantially zero ($\leqq$0.1 wt %) and it is not necessary at all to subject the pitch to filtration.

The spinning pitch obtained by treating the purified heavy component in accordance with the process described above could be spun at a temperature which was 10°–20° C. lower than that employed for spinning the pitch that had the same softening point and which was obtained by direct treatment of coal tar in accordance with the same process. A plausible explanation for this difference is as follows: the purified heavy component obtained by the method of the present invention does not contain any "unwanted components", so it yields a minimum amount of high polymerized material during high-temperature flashing and the heat treatment effected for final conversion of the isotropic pitch to a mesophase pitch; in addition, the period of heat treatment for conversion to the mesophase pitch is prolonged sufficiently to ensure complete removal of the light components; it would be for these two reasons that a highly homogeneous spinning pitch can be produced from the purified heavy component obtained by the present invention. As already mentioned, the mesophase pitch is spun at temperatures within the range where most organics are said to start to decompose, and it is a definite advantage that the spinning temperature can be reduced by 10°-20° C. within that range

EXAMPLES

The method of the present invention will be explained in more detail with reference to the following examples which are given here for illustrative purposes only and are by no means intended to limit the scope of the invention.

EXAMPLE 1

Coal tar having a specific gravity of 1.1644, fractional distillation property shown in Table 1 a xylene-insoluble content of 4.7 wt % and a quinoline-insoluble content of 0.6 wt % was flash-distilled in a flash tower at varying temperatures of 250° C., 290° C. and 340° C. to obtain heavy components. The yields of the recovered heavy components and their xylene-insoluble contents are listed in Table 2.

Each of the heavy components was heated to 100° C. and then dissolved in twice its amount of xylene of ordinary temperature under atmospheric pressure and the solution was subjected to a filtration test at 1.5 kg/cm$^2$.G and ambient temperature on a pressure filter (effective area: 0.025 m$^2$) equipped with a glass fiber impregnated filter paper (GA-200 of Toyo Roshi Kaisha Ltd.) The average rate of filtration as calculated for the period from the passage of the first one kilogram of the feed solution to the passage of the next four kilograms of the feed is also listed in Table 2 for each of the solutions of heavy components The solutions of the heavy components obtained by flash distillation in accordance with the present invention attained average filtration rates (>150 kg/ml$^2$.hr) which were appreciably higher than 33 kg/m$^2$.hr, the value attained with the solution of non-flash distilled coal tar in twice its amount of xylene. Xylene was removed from each of the filtrates by distillation and the resulting purified heavy components had xylene- and quinoline-insolubles in the amounts indicated in Table 2.

TABLE 1

| Fractional distillation property of coal tar* | |
|---|---|
| Amount of distillate (% by volume) | Temperature (°C.) |
| IBP | 189 |
| 5 | 206 |
| 10 | 221 |
| 20 | 270 |
| 30 | 322 |
| 40 | 355 |
| 50 | 401 |
| 60 | 441 |

TABLE 1-continued

| Fractional distillation property of coal tar* | |
|---|---|
| Amount of distillate (% by volume) | Temperature (°C.) |
| 70 | 521 |

*according to the method of ASTM-D-1160.

TABLE 2

| | Method of the invention | | | Comparative method |
|---|---|---|---|---|
| Temperature at flash tower °C. | 250 | 290 | 340 | untreated coal tar |
| Yield of heavy component wt % | 84.8 | 75.5 | 63.6 | 100 |
| Xylene-insoluble content in heavy component wt % | 5.8 | 7.1 | 10.6 | 4.7 |
| Filtration rate* kg/m$^2$ · hr | 154 | 213 | 374 | 33 |
| Yield of purified heavy oil wt % | 75.7 | 65.5 | 52.0 | 92.5 |
| Xylene-insoluble content in purified heavy oil wt % | 1.9 | 2.1 | 1.3 | 2.0 |
| Quinoline-insoluble content wt % | ≦0.1 | ≦0.1 | ≦0.1 | ≦0.1 |

*filtration rate at 1.5 kg/m$^2$ .G and ambient temperature

EXAMPLE 2

Coal tar which was of the same type as used in Example 1 was flash-distilled at 280° C. in a flash tower to obtain a heavy component in a yield of 80.0 wt % of the coal tar. The xylene-insoluble content of this heavy component was 6.3 wt %, which was equivalent to 5.0 wt % on the basis of coal tar. The quinoline-insoluble content of the heavy component was 1.1 wt %. This heavy component was dissolved in twice its amount of xylene, as described in Example 1 and the solution was subjected to a continuous filtration test on a continuous filter (Leaf filter of Kawasaki Heavy Industries, Ltd.; effective area, 0.084 m$^2$) using T-856 of Shikishima Canvas Co., Ltd. as a filter cloth (made of Tetoron, with an air permeability of 500 cc/min.cm$^2$). The filter cloth was precoated by returning the filtrate to the feed tank for the first 10 minutes. Filtration was carried out at a constant pressure of 2 kg/cm$^2$.G for the subsequent 2 hours and the rate of filtration for that period was determined. The residual solution in the filter was returned to the feed tank and the filter cake was dried by purging nitrogen for 30 minutes. Thereafter, the cake was removed by centrifugation. The cake-free filter cloth was immediately subjected to precoating and filtering operations, with a total of 10 filtration cycles being performed. The average rate of filtration was 166 kg/m$^2$.hr which remained substantially constant throughout the 10 cycles. The filtrate was distilled to obtain a xylene-free purified heavy component in a yield of 69.4 wt % of the coal tar. This heavy component contained 1.9 wt % of xylene insolubles and no more than 0.1 wt % of quinoline insolubles.

REFERENCE EXAMPLE 1

Coal tar which was of the same type as used in Example 1 was immediately subjected to high temperature flash distillation at 490° C., thereby obtaining a pitch at a yield of 25.6 wt % relative to the coal tar. This pitch had a softening point of 164° C., a xylene-insoluble content of 53.8 wt % and a quinoline-insoluble content of 2.3 wt %. The pitch then was dissolved in twice its amount of hydrogenated quinoline (containing 60 wt % tetrahydroquinoline) and the solution was subjected to filtration at 1.5 kg/cm$^2$.G on a pressure filter of the same type as used in Example 1 (effective area: 0.025 m$^2$). The average rate of filtration that could be attained was as low as 13 kg/m$^2$.hr.

REFERENCE EXAMPLE 2

The purified heavy component obtained in Example 2 was subjected to high-temperature flash distillation at 440° C., thereby obtaining a pitch at a yield of 31.2 wt % relative to the purified heavy component. This pitch had a softening point (ring and ball test) of 163° C., a xylene-insoluble content of 41.3 wt % and a quinoline-insoluble content of no more than 0.1 wt %. The pitch then was dissolved in twice its amount of hydrogenated quinoline (containing 60 wt % tetrahydroquinoline) and the solution was immediately (without filtration) fed into a tubular oven (ID, 8 mm) where it was subjected to continuous heat treatment at 420° C. and 50 kg/cm$^2$ for a residence time of 80 minutes (cold bases), thereby hydrogenating the pitch. The heat-treated solution was immediately subjected to high-temperature flash distillation at 450° C., thereby obtaining a hydrogenated pitch having a softening point of 187° C. A hundred grams of this pitch was put into a flash (500 ml) and heated for 3 hours in a molten salt bath at 450° C. while nitrogen was bubbled through at a rate of 8 liters/min. By these procedures, a spinning pitch which would start to soften at 294° C. was obtained. This pitch had a xylene-insoluble content of 92.0 wt %, a quinoline-insoluble content 19.1 wt % and a beta content of 72.9 wt %. The temperature of 294° C. was approximately 20° C. below the softening point (°C.) as measured by the ring and ball test specified in JIS.

The so obtained spinning pitch was spun at 350° C. and a take-up speed of 500 m/min on a spinning machine having a nozzle hole (0.25 mm$^{\phi}$ and 0.75 mm$^{L}$). The filaments were heated to 320° C. in the air at an elevation rate of 1° C./min and rendered infusible by being held at 320° C. for 20 minutes. The infusible filaments were subsequently calcinated at 1,000° C. under a nitrogen stream and graphitized at 2,700° C. The graphite fibers thus obtained had a diameter of 8.9 μm, a tensile strength of 340 kg/mm$^2$ and an elastic modulus of 56.5 tons/mm$^2$.

ADVANTAGES OF THE INVENTION

In accordance with the method of the present invention for preparing from coal tars a starting material which is suitable for use in the production of carbon products, in particular high-performance carbon fibers, light components are removed from the coal tar by the very simple method of distillation or flash distillation within the temperature range of 250°–350° C. in terms of atmospheric pressure. This eliminates the need for performing filtration on a solution of coal tar in a solvent mixture whose solubilizing ability is strictly controlled to attain the purpose of removing any unwanted components from the coal tars that should not be contained in a starting material suitable for use in the production of carbon fibers. In accordance with the method of the present invention, the heavy component obtained by distillation or flash distillation of the coal tar can be freed of the unwanted components by simply performing filtration on a solution of said heavy component in a readily available monocyclic aromatic hydrocarbon solvent such as benzene, toluene or xylene. In addition, the rate of this filtration is at least about five times as fast as the value that can be attained by prior art techniques. Graphite fibers of extremely high performance can be obtained from the starting material prepared by the method of the present invention.

What is claimed is:

1. A method of preparing a starting material for use in the production of a carbon product, said method comprising the following steps:

distilling or flash distilling coal tars, containing light component having an initial boiling point of not more than 280° C. at atmospheric pressure with a fraction in an amount of at least 10% by weight which has a boiling point between the initial boiling point and 350° C. at atmospheric pressure and xylene-insoluble components in an amount of 15% or less by weight, to remove said light component; said distilling or flash distilling being performed at a temperature of 250° C. to 350° C. to prevent substantially all thermally induced condensation, polymerization or decomposition reactions;

obtaining a heavy component which remains in the bottom of the distillation or flash column; said heavy component having a greater xylene-insoluble content of at least 1% and not more than 10% by weight than that of said coal tar; and having a xylene-insoluble content of not more than 20% by weight of said heavy component;

dissolving the obtained heavy component in 1–3 times its amount of a monocyclic aromatic hydrocarbon solvent to form a solution at a temperature ranging from ambient temperature to the boiling point of said solvent and which imparts flowability to said heavy component under atmospheric pressure or application of pressure;

separating and eliminating the insoluble component from the resulting solution by filtration or centrifugation, which insoluble component comprises free carbon and components having very high molecular weights; and subsequently eliminating the solvent by distillation so as to obtain a purified heavy component substantially being free of the above insoluble component, as said starting material.

2. The method according to claim 1 wherein said monocyclic aromatic hydrocarbon solvent is at least one member selected from the group consisting of benzene, toluene and xylene.

3. The method according to claim 1 wherein said carbon product is a high-performance carbon fiber.

4. The method according to claim 2 wherein said carbon product is a high-performance carbon fiber.

* * * * *